US006948881B1

(12) United States Patent
Fredriksson et al.

(10) Patent No.: US 6,948,881 B1
(45) Date of Patent: Sep. 27, 2005

(54) REMEDIATION INJECTION VESSEL FOR MARSHES, TIDAL FLATS, AND WETLANDS

(75) Inventors: David Fredriksson, Nottingham, NH (US); Thomas Ballestero, Madbury, NH (US); Stanley Boduch, Barrington, NH (US); Richard Clark, Newmarket, NH (US); Nancy Kinner, Lee, NH (US); Matthew Levander, Durham, NH (US); Matthew Manning, Newton, MA (US); Michael Mazzone, Durham, NH (US); Glenn McGillicuddy, Dover, NH (US); James Mulcahey, Hampton, NH (US); James Tyler, Newmarket, NH (US)

(73) Assignee: University of New Hampshire, Durham, NH (US)

( * ) Notice: Subject to any disclaimer, the term of this patent is extended or adjusted under 35 U.S.C. 154(b) by 27 days.

(21) Appl. No.: 10/395,037

(22) Filed: Mar. 21, 2003

(51) Int. Cl.[7] ..... E02D 3/12

(52) U.S. Cl. ..... 405/128.5; 405/128.75; 405/269

(58) Field of Search ..... 405/128.1, 128.15, 405/128.45, 128.5, 128.7, 128.75, 222, 223, 405/233, 248, 266, 269, 302.4

(56) References Cited

U.S. PATENT DOCUMENTS

| | | | | |
|---|---|---|---|---|
| 4,069,678 A | * | 1/1978 | Miura et al. | 405/263 |
| 4,072,017 A | * | 2/1978 | Shiraki | 405/270 |
| 5,127,765 A | * | 7/1992 | Millgard | 405/128.45 |

FOREIGN PATENT DOCUMENTS

| | | | |
|---|---|---|---|
| GB | 2079345 | * | 1/1982 |
| JP | 57-209318 | * | 12/1982 |
| JP | 57209318 | | 12/1982 |

* cited by examiner

*Primary Examiner*—Sunil Singh
(74) *Attorney, Agent, or Firm*—Weingarten, Schurgin, Gagnebin & Lebovici LLP

(57) ABSTRACT

An injection vessel for injecting liquid amendment into contaminated subsurface sediment in ecologically sensitive areas such as shallow water salt marshes, tidal flats, or fresh water wetlands is disclosed. The injection vessel described herein includes a shallow-draft floating platform that has an injection system mounted thereon. The injection system includes an injection grid containing a plurality of injection syringes that receive liquid amendment from a metering pump. The injection grid is lowered such that the output of the injection syringes is within the contaminated sediment. The metering pump provides the liquid amendment to the injection syringes and a fluid path is established that injects the liquid amendment into the contaminated sediment. A propulsion system mounted on the floating platform provides for locomotive and maneuvering power. A control system allows the operation of the system either in a semi-autonomous mode in which an on-board controller is programmed to provide the command signals, or in a remote control mode with an operator providing real time command signals through either a wireless or wired controller. The control system provides propulsion commands to the propulsion system and injection commands to the injection system. The propulsion commands include both locomotive commands and maneuvering commands. The injection commands include the lowering and raising of the injection gird and the operation of the metering pump to dispense the predetermined amount of liquid amendment.

46 Claims, 7 Drawing Sheets

REMEDIATION INJECTION VESSEL FOR MARSHES, TIDAL FLATS, AND WETLANDS

STATEMENT REGARDING FEDERALLY SPONSORED RESEARCH OR DEVELOPMENT

The work leading to this invention was carried out with United States Government support provided under a grant from the NOAA, Grants No. NA16RG1035, and NA070R0351. Therefore, the U.S. Government has certain rights in this invention.

CROSS REFERENCE TO RELATED APPLICATIONS

BACKGROUND OF THE INVENTION

This invention relates to injection vessels capable of injecting liquid amendment into contaminated sediment, and in particular to injection vessels capable of operating in shallow salt water and fresh water systems with little environmental impact.

Remediation of contaminated sediment in shallow salt water marshes, tidal flats, or fresh water wetlands, after ecological harm has occurred, should be performed in a manner to minimize the intrusion of the remediation equipment in these ecologically sensitive areas. Sediment remediation techniques that are currently used typically involve dredging, tilling, installing horizontal wells, and manually injecting liquid amendment into the contaminated subsurface sediment. The various types of equipment that are currently used to perform these operations are usually large, bulky, noisy, and polluting, hence the anthropogenic impact of these methods and the equipment used to carry out these methods can be substantial.

Therefore, it would be advantageous to provide an injection vessel that is capable of delivering liquid amendment into the sediment without adversely impacting the ecologically sensitive environment in which it operates.

BRIEF SUMMARY OF THE INVENTION

An injection vessel for injecting liquid amendment into contaminated subsurface sediment in ecologically sensitive areas such as shallow water salt marshes, tidal flats, or fresh water wetlands is disclosed. The injection vessel described herein includes a shallow-draft floating platform that has an injection system mounted thereon. The injection system includes an injection grid containing a plurality of injection syringes that receive liquid amendment from a metering pump. The injection grid is lowered such that the output of the injection syringes is within the contaminated sediment. The metering pump provides the liquid amendment to the injection syringes and a fluid path is established that injects the liquid amendment into the contaminated sediment. A propulsion system mounted on the floating platform provides for locomotive and maneuvering power.

A control system allows the operation of the system either in a semi-autonomous mode in which an on-board controller is programmed to provide the command signals, or in a remote control mode with an operator providing real time command signals through either a wireless or wired controller. The control system provides propulsion commands to the propulsion system and injection commands to the injection system. The propulsion commands include both locomotive commands and maneuvering commands. The injection commands include the lowering and raising of the injection grid and the operation of the metering pump to dispense the predetermined amount of liquid amendment.

In one aspect, the propulsion system of the injection vessel includes a pair of paddle wheels that are mounted on the floating platform and are powered by a pair of electric motors coupled to the controller. In one embodiment, the propulsion commands can be forward or reverse and on and off for each motor.

In another aspect, the controller includes an on-board computer/controller that receives commands from an off-vessel user having a field computer, wherein the field computer and the on-board computer/controller are coupled via a wireless connection, which can be a radio frequency or optical link. The commands can be generated by a user using the field computer via a keyboard, keypad, or controller such as a joystick. In another aspect the on-board computer/controller receives commands from a hardwired controller operated by a user, and wherein the controller can be a joystick. In another aspect, the on-board computer/controller can receive commands programmed and stored in a programmable memory coupled to the on-board computer/controller, or the programmable memory can be coupled to the field computer and transmitted over the wireless link.

Other features, functions, and aspects of the invention will be evident from the Detailed Description of the Invention that follows.

BRIEF DESCRIPTION OF THE SEVERAL VIEWS OF THE DRAWING

The invention will be more fully understood with reference to the following Detailed Description of the Invention in conjunction with the drawings of which.

DETAILED DESCRIPTION OF THE INVENTION

Figure 1:
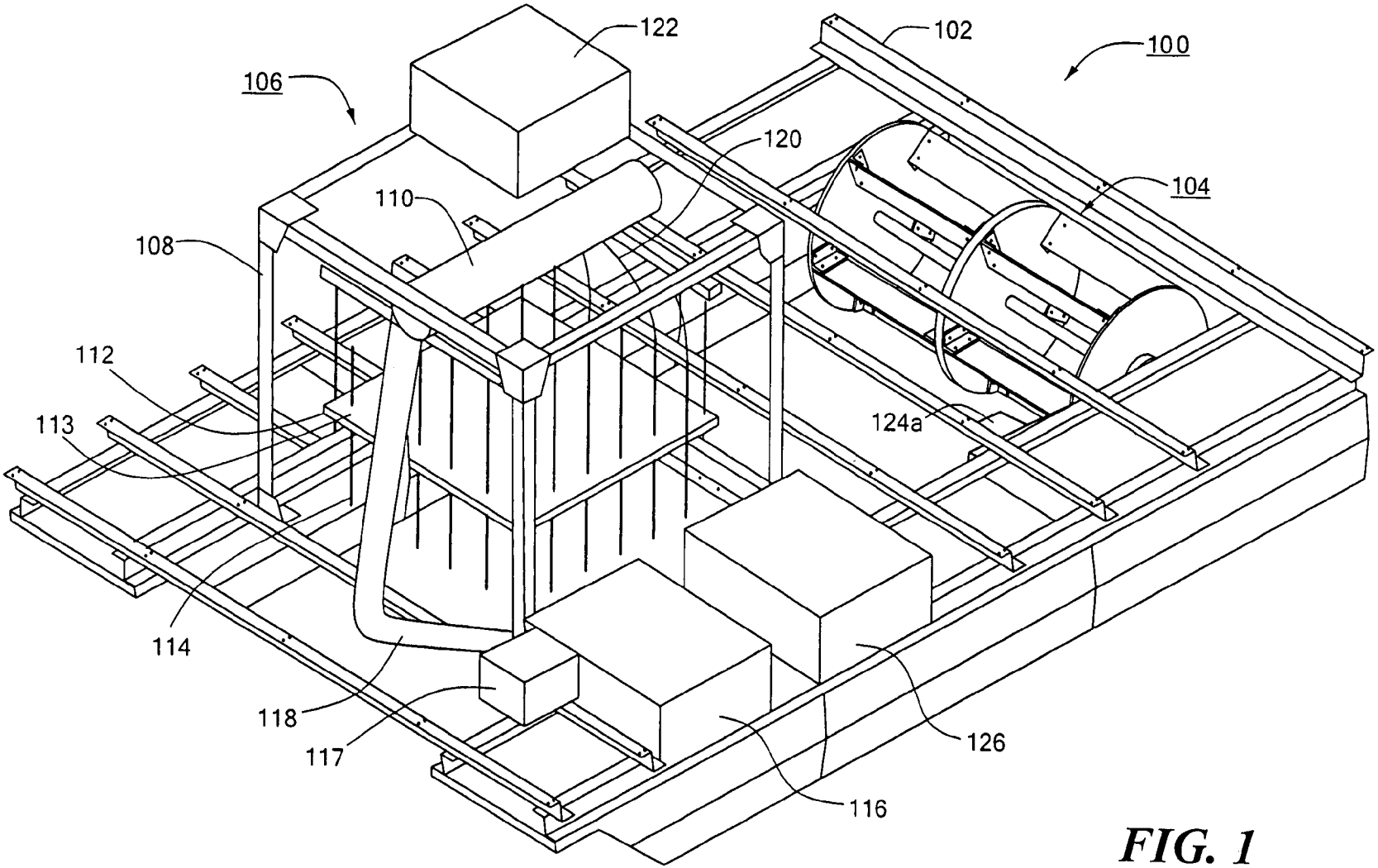
FIG. 1 is an isometric view of an embodiment of the injection vessel.

FIG. 1 depicts an embodiment of the present injection vessel. In particular, the injection vessel 100 includes a floating platform 102 that is powered by propulsion system 104 that includes electric motors 124*a* and 124*b*, where motor 124*b* is not visible in FIG. 1. The injection vessel 100 also includes an injection assembly 106 that includes an injection frame assembly 108 securely mounted to the floating platform 102 and an injection manifold 110 that is securely mounted to the injection frame assembly 108. The injection assembly 106 further includes a moveable injection grid assembly 112 that is positioned within the injection frame assembly and that includes a plurality of openings 113 at least one of which has an injector assembly 114 securely affixed therewithin. The injector assembly 114 is fluidly coupled to the injection manifold 110 via flexible tubing 120. A reservoir 116 containing the liquid amendment is securely mounted on the floating platform 102 and is fluidly coupled to a metering pump 117. The metering pump 117 provides a predetermined amount of the liquid amendment to the injection manifold 110 via a pipe 118. A raising/lowering mechanism 122 is securely mounted on the injection frame assembly 108 and is mechanically coupled to the injection grid assembly 112 in order to raise and lower it. The injection grid assembly 112 is guided in its movements on the vessel through a series of stabilizer stanchions 128. A control system 126 is coupled to the electric motors 124*a* and 124*b*, to the raising/lowering mechanism 122, and to the metering pump 117 to provide the various control signals needed to operate the injection vessel 100. In the preferred embodiment, the raising/lowering mechanism 122 is a winch that is coupled via cables to the injection grid assembly 112. Furthermore, in the preferred embodiment the injection manifold 110 is a 6" diameter PVC pipe with outlets provided evenly spaced about one-half the exterior. Preferably there are 6 outlets spaced 30 degrees apart with the pattern repeated as needed and dependent upon the maximum number of injector assemblies that are to be used. In addition, in the preferred embodiment, the injection grid assembly 112 is preferably Duragrate® molded fiberglass grating.

In operation, the control system 126 navigates the injection vessel 100 to a predetermined location via control signals sent to the electric motors 124*a* and 124*b*. The control system 126 then instructs the raising/lowering mechanism 122 to lower the injection grid assembly 112 containing the injector assembly 114 such that a portion of the injector assembly 114 is inserted into the contaminated subsurface sediment. The metering pump 117 is then signaled to provide the liquid amendment to the injector assembly 114 to inject the liquid amendment into the contaminated subsurface sediment. The raising/lowering mechanism 122 is signaled to raise the injector grid 112, thus raising the injector assembly 114 out of the sediment. The control system 126 then selects the next location to be remediated, and provides control signals to the electric motors 124*a* and 124*b* to move the injection vessel 100 to the next selected location.

Figure 2:
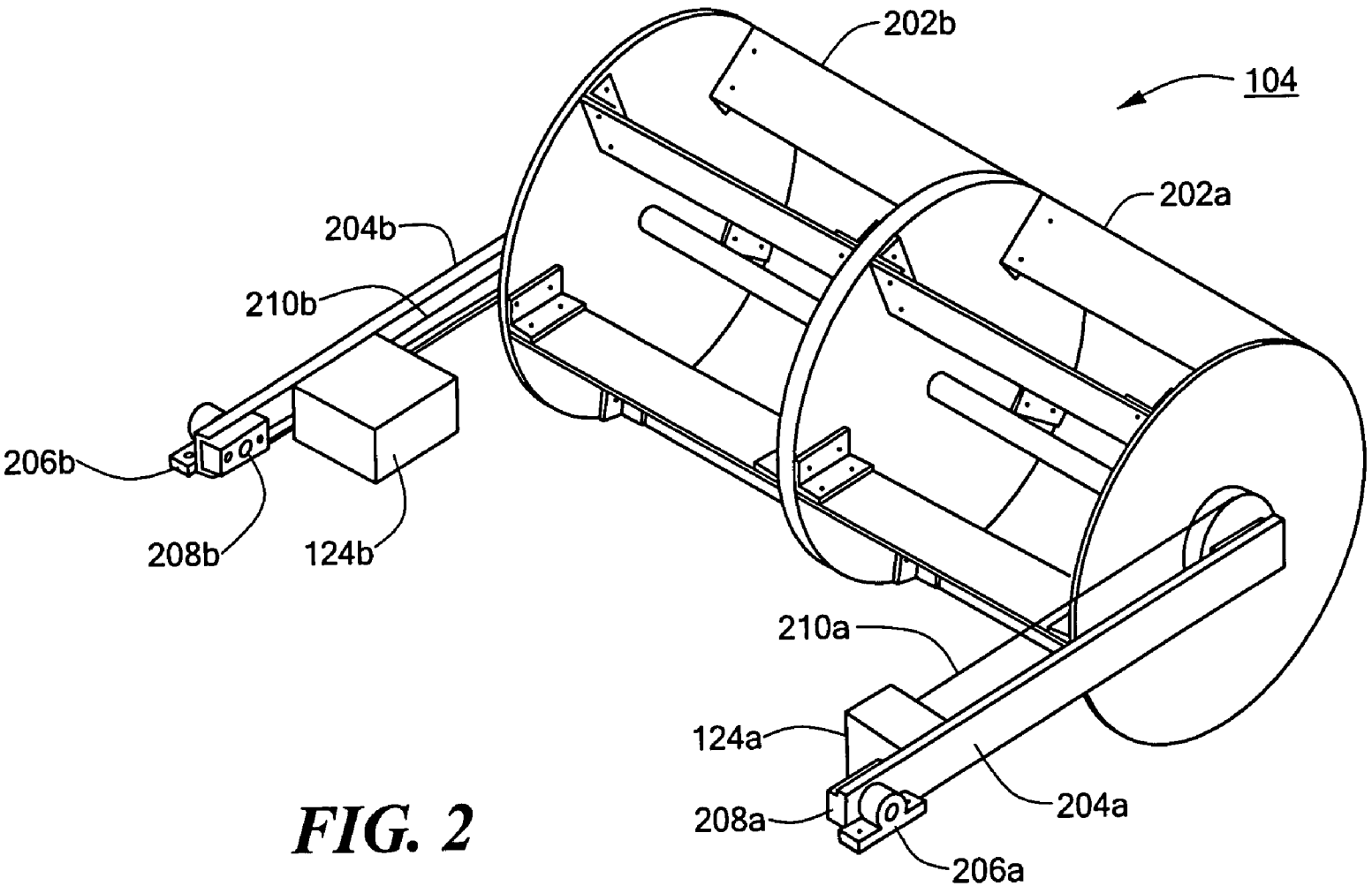
FIG. 2 is an isometric view of an embodiment of the propulsion system suitable for use with the injection vessel depicted in FIG. 1.

FIG. 2 depicts an embodiment of the propulsion system 104 of the injection vessel 100 depicted in FIG. 1. The propulsion system 104 includes a pair of paddle wheels 202*a* and 202*b* that are independently powered by electric motors 124*a* and 124*b* via drive belts 210*a* and 210*b* respectively. The two paddle wheels are mounted between a pair of rigid paddle swing arms 204*a* and 204*b* such that each paddle wheel 202*a* and 202*b* can rotate independently of the other. The paddle wheel swing arms 204*a* and 204*b* are mounted to the floating platform 102 by pivot bearings 206*a* and 206*b* respectively. The two pivot bearings are securely attached to the floating platform 102 and are configured and arranged to allow the two paddle wheels 202*a* and 202*b* to be raised and lowered into and out of the water as needed. A pair of shaft supports 208*a* and 208*b* are inserted into the swing arms 204*a* and 204*b* to provide for added support and rigidity. The electric motors 124*a* and 124*b* can be securely mounted to the swing arms 204*a* and 204*b* respectively or may be securely mounted on the floating platform 102.

In the preferred embodiment, the two electric motors are 24 volt DC motors, that are capable of providing rotation in either direction such that the individual paddle wheels can be counter rotated with respect to one another to allow the injection vessel to turn and maneuver. In this embodiment, the swing arms are constructed out of anodized aluminum and the paddle wheels are constructed from fiberglass reinforced plastic.

Figure 3:
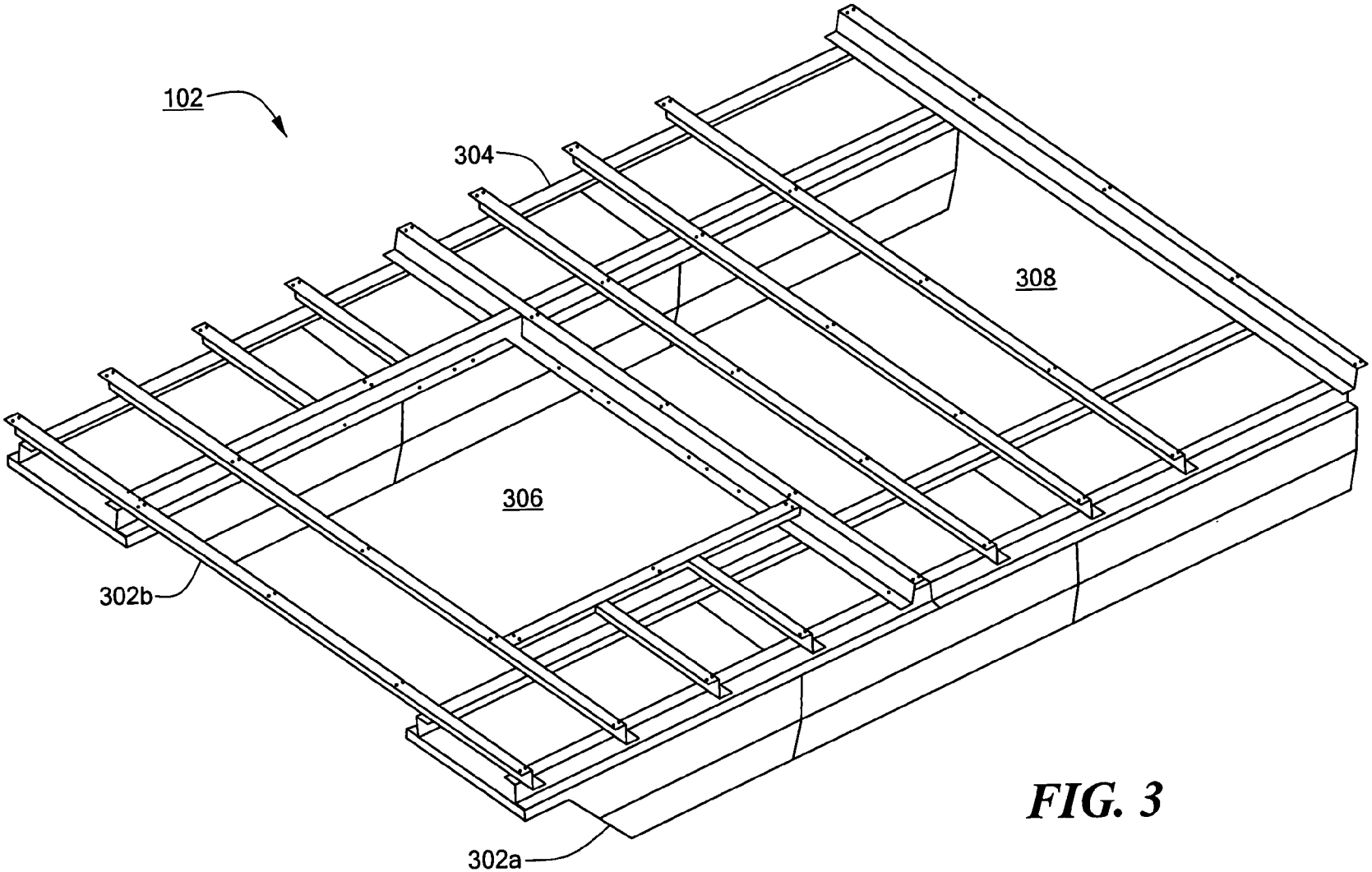
FIG. 3 is an isometric view of an embodiment of a floating platform suitable for use with the injection vessel depicted in FIG. 1.

FIG. 3 depicts an embodiment of the floating platform 102 of the injection vessel 100 depicted in FIG. 1. In particular, the floating platform 102 includes a pair of pontoons 302*a* and 302*b* on which a frame 304 is constructed and securely attached thereto. The frame includes a pair of openings. The first opening, the injector well 306 is sized and configured to allow the injection grid assembly 112 to pass therethrough. The second opening, the paddle wheel well 308 is sized and configured to allow the pair of paddle wheels 202*a* and 202*b* to operate.

In the preferred embodiment, the floating platform 102 is a pontoon boat using a plurality of ¼" thick pontoons held together by anodized aluminum "z-bars" and stainless steel fasteners. A suitable pontoon boat is manufactured by Rettey Corporation, Colchester, Ill.

Figure 4:
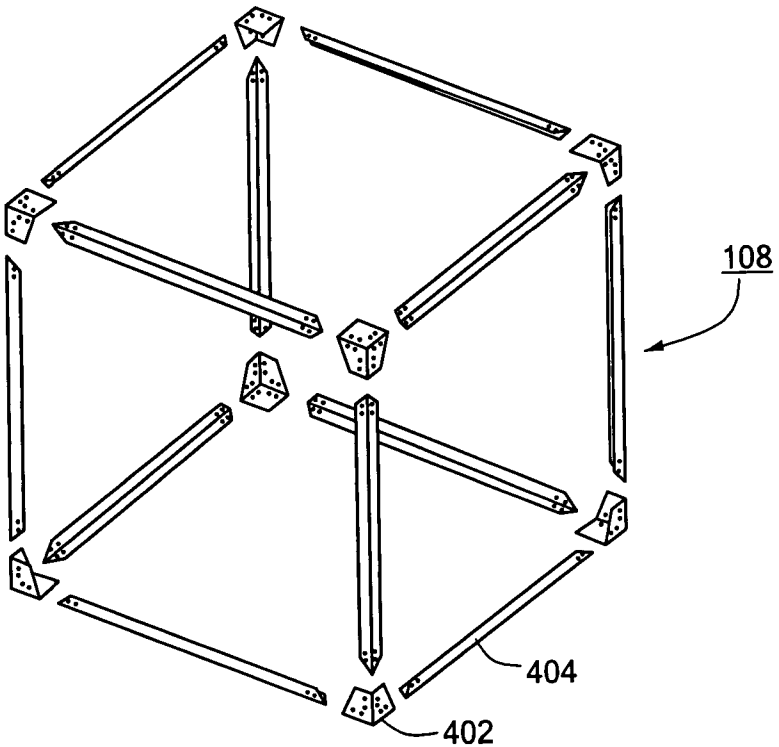
FIG. 4 is an isometric view of an embodiment of an injection frame assembly suitable for use with the injection vessel depicted in FIG. 1.

FIG. 4 depicts an embodiment of the injection frame assembly 108 of the injection vessel 100 depicted in FIG. 1. In particular, the injection frame assembly 108 includes eight corner brackets 402 and twelve frame members 404 that are connected as depicted using a suitable fastening method such as a screw/washer/locknut assembly or riveting. In the preferred embodiment, the eight corner brackets 402 and twelve frame members are formed from 11 gauge stainless steel.

Figure 5:
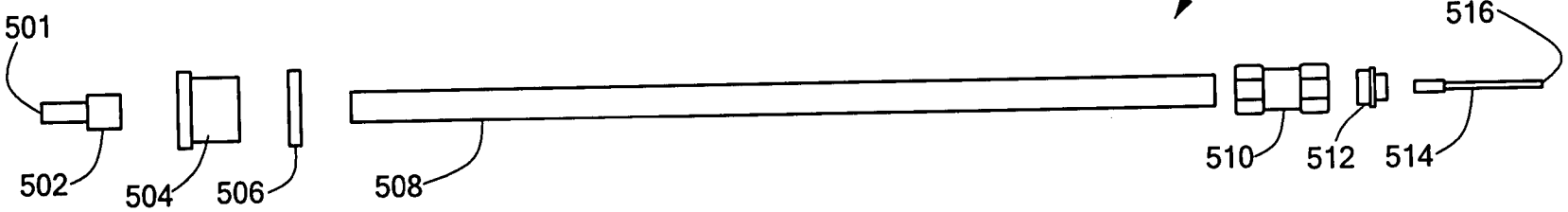
FIG. 5 is an exploded view of an embodiment of an injector assembly suitable for use with the injection vessel depicted in FIG. 1.

As depicted in FIG. 1, the injection assembly 106 includes a plurality of injector assemblies 114 receiving liquid amendment via flexible tubing 120 from the injection manifold 110. FIG. 5 depicts an embodiment of an injector assembly 114 of the injection vessel 100 depicted in FIG. 1. In particular, the injector assembly 114 includes a fluid input 501 in which the flexible tubing 120 is pressed onto a barbed hose nipple 502. The barbed hose nipple 502 is coupled to an injector barrel 508 via a bushing 504 and a bushing plate 506. The bushing 504 and bushing plate 506 are sized and configured to fit into, but not pass through, one of the plurality of openings 113 in the injection grid assembly 112. The injector barrel 508 is slidably received in the bushing 504 and bushing plate 506 but the bushing 504 and bushing plate 506 are unable to pass through. Thus, the injector barrel 508 is able to slide within the bushings such that the needle 514 can be responsive to the contours of the sediment or obstacles within the sediment by sliding within the bushing 504. The injector barrel 508 is coupled to a needle 514 having a fluid output 516 via a check valve 510 and a male luer lock 512 that is sized and configured to accept the check valve at a first end and the needle 514 at a second end.

Figure 6:
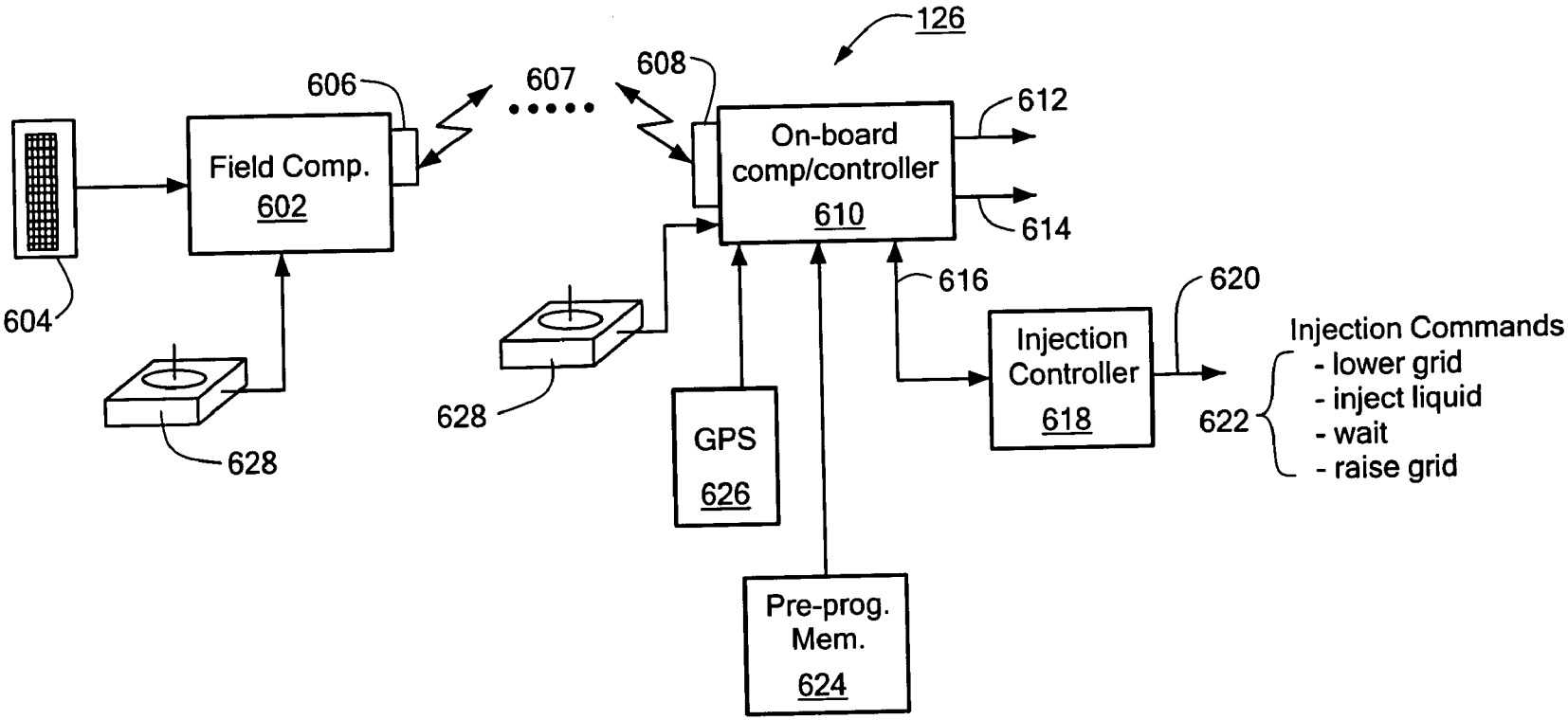
FIG. 6 is a block diagram of an embodiment of a control system suitable for use with the injection vessel depicted in FIG. 1.

FIG. 6 depicts an embodiment of the control system 126 of the injection vessel 100 depicted in FIG. 1. The control system includes an on-board computer/controller 610 that receives commands from one or more inputs, e.g., an off-vessel operator via a wireless link, an on-board or off-vessel operator using a hard-wired joystick or other form of controller, or an on-board memory that has been preprogrammed with instructions and provides one or more output control/command signals. As will be discussed in more detail below, the control system 126 also includes an injection controller 618.

In particular, in response to movement commands, the on-board controller provides first and second motor control signals 612 and 614 respectively to the first and second electric motors, 124*a* and 124*b*, respectively. In the preferred embodiment, the movement commands control forward and reverse operation of each of the pair of paddle wheels, 202*a* and 202*b*. In this embodiment, the on-board computer/controller 610 provides forward-reverse and on-off commands to the motors and their associated control electronics to provide for movement and maneuvering of the injection vessel. In another embodiment, the computer/controller 610 can provide fractional power commands to control the speed and direction of each paddle wheel 202*a* and 202*b*.

The on-board computer/controller 610 also provides an injection initiation signal 616 to an injection controller 618. The injection controller provides the necessary injection commands 622 to the injection system via line 620 and provides monitoring data to the on-board computer/controller. The injection controller 618 provides the injection commands 622 to the raising/lowering mechanism 122 to lower the injection grid 112, to the metering pump 117 to dispense the predetermined amount of liquid amendment, to the system as a whole to wait a predetermined amount of time for the injected liquid amendment to settle into the sediment, and to the raising/lowering mechanism 122 to raise the injection grid 112.

The control system 126 includes a variety of operational command modes. In one embodiment, an off-vessel operator using a field computer 602 communicates via a wireless connection 607 between a wireless modem 606 coupled to the field computer 602 and a second wireless modem 608 coupled to the on-board computer 610. The off-vessel operator receives data from the on-board computer 610 and provides instructions and commands to the on-board computer 610. In this embodiment, the off-vessel operator interfaces to the field computer 602 via a HyperTerminal that allows direct control over the on-board computer 610. In the preferred embodiment, the wireless connection 607 is a 900 MHz spread spectrum radio signal and the wireless modems are Ewave Super Screamer multi-protocol wireless modems available from Ewave, Inc. of Dallas Tex. Advantageously, by not having an operator onboard the injection vessel, the vessel will draw less water, enabling the injection vessel to have potentially more access to contaminated areas while minimizing the environmental impact on the area. In another embodiment, the wireless connection can be an optical connection, such as using infrared radiation.

Figure 7:
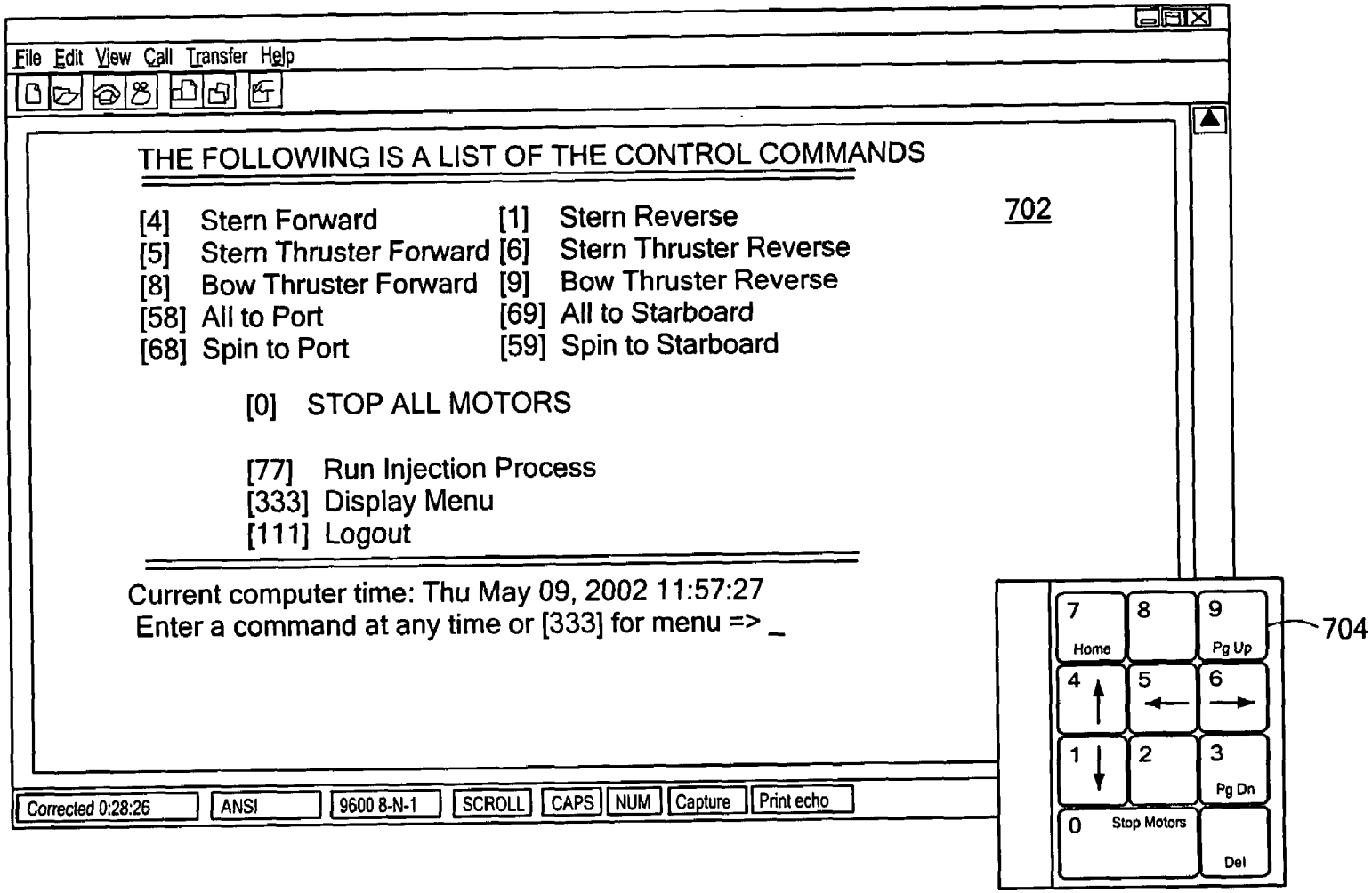
FIG. 7 is a display of a page of data from one the control system depicted in FIG. 6.
Figure 8:
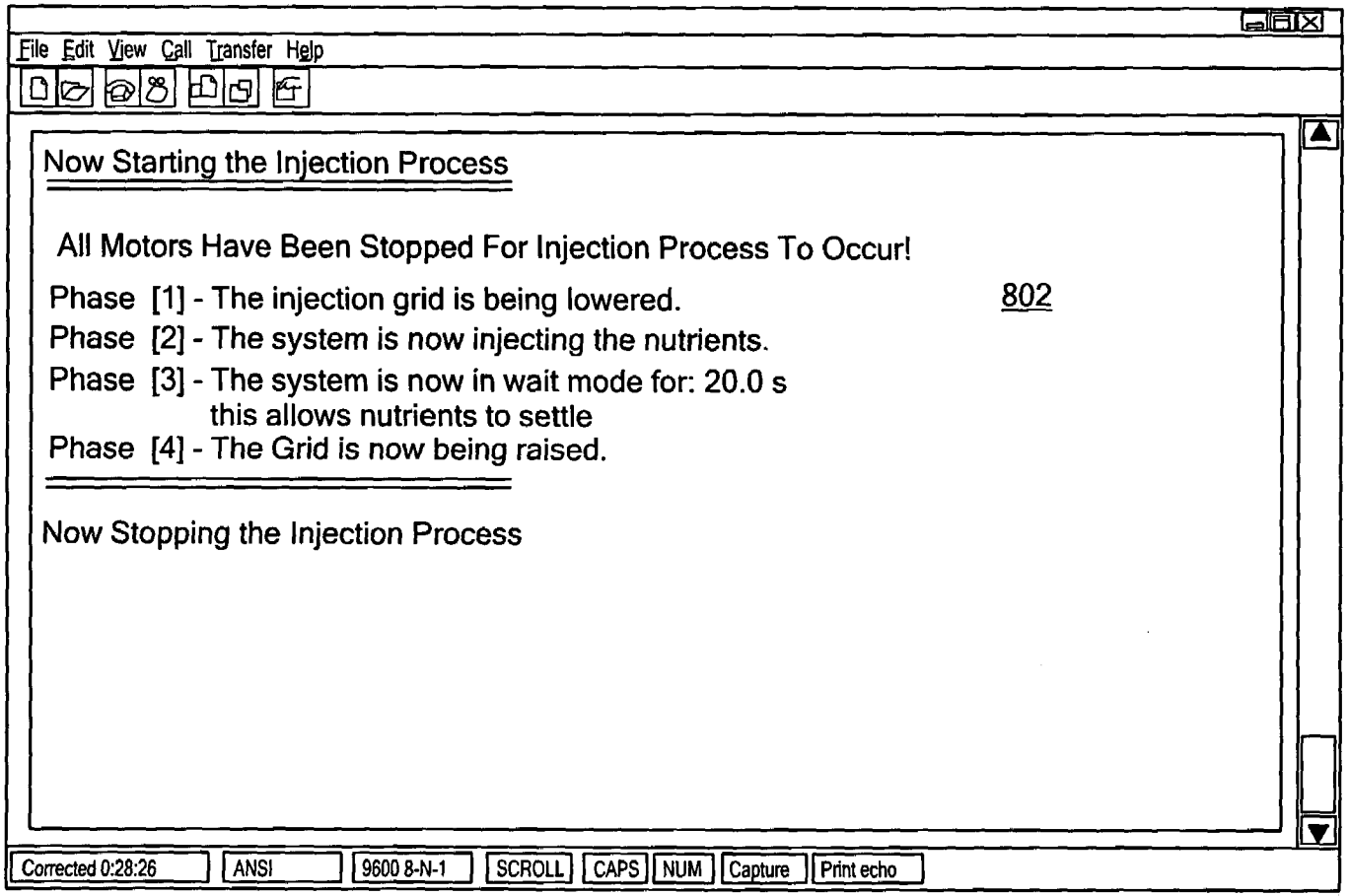
FIG. 8 is a display of a page of data from the injection controller depicted in FIG. 6.

In this preferred embodiment, as depicted in FIG. 7, the off-vessel operator has a window display 702 that can display a menu of operational commands, data from the on-board computer/controller 610, data from the injection controller 618 or other data that is needed by the operator for the operation of the injection vessel. Thus, the movement of the injection vessel is controlled via keypad strokes 704 on keyboard 604. In the illustrated embodiment, other keypad or keyboard strokes may be used to provide commands to the system. Alternatively, a controller such as a joy-stick 628 may be provided as an input to the field computer 602 to provide movement commands and to initiate the injection process by using the controller trigger button. FIG. 8 depicts an embodiment of a window 802 displaying the injection controller data for the operator.

In another embodiment, a joystick or other controller 628 is hardwired into the on-board computer/controller 610 to provide a direct input from the user to the on-board computer/controller 610. In this embodiment, the user may be located on the injection vessel itself or may be off-vessel and tethered to the on-board computer/controller 610 via a cable of sufficient length. Movement commands are based on the position of the joy-stick and the initiation of the injection process is provided by depressing the trigger button of the joystick.

In another embodiment, the movement and injection process initiation commands to the on-board computer/controller 610 can be pre-programmed into a memory 624 and executed autonomously by the on-board computer/controller 610. Navigation, movement and maneuvering, and injection control can be pre-programmed. If an optional global positioning receiver is used, as discussed in more detail below, the injection vessel can be nearly autonomous since the on-board computer/controller will have all the information necessary to carry out a pre-programmed mission. The data can include for example, the starting position of the injection vessel, preselected locations to inject the liquid amendment, the amount of liquid amendment, and the final location. The controller can be programmed with navigation and route selecting algorithms to aid in this process. In this embodiment, it may be desirable for an operator to monitor the injection vessel and to be able to manually override the injection vessel on-board computer/controller 610 in the event of a failure or an emergency. Accordingly, the wireless system described above could be used. In another embodiment, the programmable memory can be coupled to the field computer and commands and data transmitted via the wireless connection between the field computer and the on-board computer/controller.

The on-board computer/controller 610 can also include an on-board global positioning system (GPS) receiver 626 to provide location and velocity data. The GPS receiver 626 can incorporate a differential GPS receiver so that sub-meter positioning can be achieved during injections. The differential GPS receiver can be configured to work with the US Coast Guard correction signal for marine purposes as well as the Wide Angle Augmentation System (WAAS) supported by the Federal Aviation Administration (FAA) such that corrections inland may be achieved as well. In addition, the GPS receiver 626 can be configured to support third-party corrections such as the satellite system by Omni-Star for corrections world wide. A suitable GPS receiver is available from Trimble Navigation Ltd., Sunnyvale, Calif.

In the preferred embodiment, the field computer 602 is a suitable lap-top computer that can be interfaced to a network such as an Ether Net and provide the necessary processing and graphics for the user. A suitable on-board computer/controller is the TEMPERATURE SENSING-2800 SBC DOS based computer/controller available from Technologic Systems, Fountain Hills, Ariz. This computer/controller was selected since it is a completely self contained module and includes a DOS ROM based operating system with full TCP/IP support, 2 PC/AT RS232 serial ports, 8 Mbytes of RAM, 1 Mbyte of FLASH RAM, 24 I/O ports, self-contained time clocks, a lithium battery and battery backed CMOS memory. In the preferred embodiment, the injection controller 618 is a programmable logic controller that is powered using 12 volts and accepts 8 DC inputs and has 6 outputs. Relays or electronic switches then provide the appropriate current to the raising/lowering mechanism 122, which as provided above is preferably a winch and cable system. The interface between the on-board computer/controller 610 and the injection controller 618 is preferably via an Ethernet.

It should be appreciated that other variations to and modifications of the above-described injection vessel may be made without departing from the inventive concepts described herein. Accordingly, the invention should not be viewed as limited except by the scope and spirit of the appended claims.

What is claimed is:

1. An injection vessel to inject a liquid amendment into contaminated sediment, the injection vessel comprising:

a floating platform;

a propulsion system affixed to the floating platform, the propulsion system configured and arranged to provide locomotive power and to enable the floating platform to maneuver;

an injection assembly comprising:

a supply apparatus configured and arranged to hold the liquid amendment;

a metering pump having an output and an input, the input coupled to the supply apparatus, the metering pump configured and arranged to receive the liquid amendment from the supply apparatus and to provide a predetermined volume of the liquid amendment at the output;

at least one injector assembly having an output and an input, the input coupled to the output of the metering pump, the injector assembly configured and arranged to be moveable from a first position to a second position and when moved to the second position to penetrate the sediment such that the output is below the surface of the sediment to provide a fluid pathway from the metering pump to the output of the syringe to inject the liquid amendment into the sediment; and a control system coupled to the propulsion system to provide propulsion and maneuvering commands thereto, the control system further coupled to the injection assembly to control the movement of the at least one injector assembly and to control the volume output of the metering pump, the control system further comprising injection commands to lower the at least one injector assembly to a lowered position, and to dispense a predetermined amount of liquid amendment through the injector assembly into the sediment while the injector assembly is maintained in the lowered position.

2. The injection vessel of claim 1 wherein the floating platform includes an opening therethrough, and wherein the at least one moveable injector assembly is aligned with the opening such that the at least one moveable injector assembly can be raised and lowered through the opening.

3. The injection vessel of claim 2 wherein the injection assembly further comprises:

an injection grid having a plurality of openings;

the injector assembly secured within one of the plurality of openings;

the injection grid aligned with the opening in the floating platform;

a plurality of stabilizer stanchions securely coupled to the floating platform, the injection grid slidably coupled to the plurality of stabilizer stanchions, wherein the stabilizer stanchions guide the motion of the injection grid;

a raising and lowering mechanism coupled to the injection grid and operative to raise and lower the injection grid and the injector assembly therein, the raising and lowering mechanism coupled to the injection controller and responsive thereto by raising and lowering the injection grid.

4. The injection vessel of claim 3 wherein the at least one injector assembly is a plurality of injector assemblies and the plurality of injector assemblies are disposed within a corresponding plurality of openings in the injection grid and wherein at least one of the plurality of injector assemblies is fluidly coupled to the metering pump and receives the predetermined volume of liquid amendment from the metering pump.

5. The injection vessel of claim 3 further comprising an injector manifold having an input coupled to the metering pump and providing a plurality of fluid outputs and wherein each of the plurality of injector assemblies that are fluidly coupled to the metering pump is fluidly coupled via a respective one of the plurality of fluid outputs.

6. The injection vessel of claim 3 wherein the raising and lowering mechanism is a winch.

7. The injection vessel of claim 1 wherein the control system includes an on-board computer/controller and a field computer, the on-board computer/controller being coupled to the field computer via a wireless connection and receives commands therefrom.

8. The injection vessel of claim 7 wherein the wireless connection is a radio frequency connection.

9. The injection vessel of claim 7 wherein the wireless connection is an optical connection.

10. The injection vessel of claim 7 wherein the field computer receives an input from a keyboard.

11. The injection vessel of claim 7 wherein the field computer receives an input from a controller.

12. The injection vessel of claim 11 wherein the controller is a joystick.

13. The injection vessel of claim 1 wherein the control system includes an on-board computer/controller and a controller, the controller hardwired to the on-board computer/controller via a cable, the on-board computer/controller operative to receive commands from the controller.

14. The injection vessel of claim 13 wherein the controller is a joystick.

15. The injection vessel of claim 1 wherein the control system includes an on-board computer/controller and programmable memory programmable with at least one command, the on-board computer/controller is coupled to the programmable memory and receives commands from the programmable memory.

16. The injection vessel of claim 1 further including a global positioning system (GPS) receiver coupled to the controller.

17. The injection vessel of claim 16 wherein the GPS receiver is a differential GPS receiver.

18. The injection vessel of claim 1 wherein the propulsion system includes first and second paddle wheels mounted on the floating platform and first and second electric motors coupled to the first and second paddle wheels respectively and configured and arranged to provide power there to the first and second electric motors further coupled to the control system and receiving propulsion commands therefrom.

19. The injection vessel of claim 18 wherein the propulsion commands include forward and reverse and on/off.

20. The injection vessel of claim 18 wherein the first and second paddle wheels are mounted on the floating platform such that each paddle wheel can rotate in the opposite direction as the other paddle wheel.

21. The injection vessel of claim 1 wherein the injector assembly includes a barbed hose input end coupled to the input end of the syringe, the barbed hose input end fluidly coupled to the metering pump, the injector assembly syringe further including a bushing, wherein the barbed hose input end and bushing are coupled to the input end of the injector assembly, the injector assembly further including a check valve having an input and output and a needle, the needle being coupled to the output of the check valve, the input of the check valve being coupled to the output end of the injector assembly, and wherein the needle provides the fluid output of the injector assembly.

22. The injection vessel of claim 21 further including an injection grid assembly having a plurality of openings, the plurality of openings being sized and configured to accept the bushing to hold the injector assembly in place.

23. The injection vessel of claim 1 wherein the floating platform is a pontoon boat.

24. A system for injecting a liquid amendment into a contaminated sediment, the system comprising:

an injection vessel comprising:

a floating platform;

a propulsion system affixed to the floating platform, the propulsion system configured and arranged to provide locomotive power and to enable the floating platform to maneuver;

an injection assembly comprising:

a supply apparatus holding the liquid amendment to treat the contaminated sediment;

metering pump having an output and an input, the input coupled to the supply apparatus, the metering pump configured and arranged to receive the liquid amendment from the supply apparatus and to provide a predetermined volume of the liquid amendment at the output;

at least one injector assembly having an output and an input, the input coupled to the output of the metering pump, the injector assembly configured and arranged to be moveable from a first position to a second position and when moved to the second position to penetrate the sediment such that the output is below the surface of the sediment to provide a fluid pathway from the metering pump to the output of the injector assembly to inject the liquid amendment into the sediment;

a control system coupled to the propulsion system to provide propulsion and maneuvering commands thereto, the control system further coupled to the injection assembly to control the movement of the at least one injector assembly and to control the volume output of the metering pump; and wherein the control system provides propulsion commands to the propulsion system to maneuver the floating platform to a predetermined location, commands to the injector assembly to lower the injector assembly into the sediment at the predetermined location, commands to the metering pump to provide a predetermined amount of liquid amendment to the injector assembly for injection into the sediment, and commands to the injector assembly to raise the injector assembly from the sediment.

25. The system of claim 24 wherein the floating platform includes an opening therethrough, and wherein the at least one moveable injector assembly is aligned with the opening such that the at least one moveable injector assembly can be raised and lowered through the opening.

26. The system of claim 25 wherein the injection assembly further comprises:

an injection grid having a plurality of openings;

the injector barrel injector assembly secured within one of the plurality of openings;

a plurality of stabilizer stanchions securely coupled to the floating platform, the injection grid slidably coupled to the plurality of stabilizer stanchions, wherein the stabilizer stanchions guide the motion of the injection grid;

the injection grid aligned with the opening in the floating platform;

a raising and lowering mechanism coupled to the injection grid and operative to raise and lower the injection grid and the injector assembly therein, the raising and lowering mechanism coupled to the injection controller and responsive thereto by raising and lowering the injection grid.

27. The system of claim 26 wherein the at least one injector assembly is a plurality of injector assemblies and the plurality of injector assemblies is disposed within a corresponding plurality of openings in the injection grid and wherein at least one of the plurality of injector assemblies is fluidly coupled to the metering pump and receives the predetermined volume of liquid amendment from the metering pump.

28. The system of claim 26 further comprising an injector manifold having an input coupled to the metering pump and providing a plurality of fluid outputs and wherein each of the plurality of injector assemblies that is fluidly coupled to the metering pump is fluidly coupled via a respective one of the plurality of fluid outputs.

29. The system of claim 26 wherein the raising and lowering mechanism is a winch.

30. The system of claim 24 wherein the control system includes an on-board computer/controller and a field computer, the on-board computer/controller being coupled to the field computer via a wireless connection and receives commands therefrom.

31. The system of claim 30 wherein the wireless connection is a radio frequency connection.

32. The system of claim 30 wherein the wireless connection is an optical connection.

33. The system of claim 30 wherein the field computer receives an input from a keyboard.

34. The system of claim 30 wherein the field computer receives an input from a controller.

35. The system of claim 34 wherein the controller is a joystick.

36. The system of claim 24 wherein the control system includes an on-board computer/controller and a controller, the controller hardwired to the on-board computer/controller via a cable, the on-board computer/controller operative to receive commands from the controller.

37. The system of claim 36 wherein the controller is a joystick.

38. The system of claim 24 wherein the control system includes an on-board computer/controller and programmable memory programmable with at least one command, the on-board computer/controller is coupled to the programmable memory and receives commands from the programmable memory.

39. The system of claim 24 further including a global positioning system (GPS) receiver coupled to the controller.

40. The system of claim 39 wherein the GPS receiver is a differential GPS receiver.

41. The system of claim 24 wherein the propulsion system includes first and second paddle wheels mounted on the floating platform and first and second electric motors coupled to the first and second paddle wheels respectively and configured and arranged to provide power there to, the first and second electric motors further coupled to the control system and receiving propulsion commands therefrom.

42. The system of claim 41 wherein the propulsion commands include forward and reverse and on/off.

43. The system of claim 41 wherein the first and second paddle wheels are mounted on the floating platform such that each paddle wheel can rotate in the opposite direction as the other paddle wheel.

44. The system of claim 24 wherein the injector assembly includes a barbed hose input end coupled to the input end of the injector assembly, the barbed hose input end fluidly coupled to the metering pump, the injector assembly further including a bushing, wherein the barbed hose input end and bushing are coupled to the input end of the injector assembly, the injector assembly further including a check valve having an input and output and a needle, the needle being coupled to the output of the check valve, the input of the check valve being coupled to the output end of the injector assembly, and wherein the needle provides the fluid output of the injector assembly.

45. The system of claim 44 further including an injection grid assembly having a plurality of openings, the plurality of openings being sized and configured to accept the bushing to hold the injector assembly in place.

46. The system of claim 24 wherein the floating platform is a pontoon boat.

* * * * *

UNITED STATES PATENT AND TRADEMARK OFFICE

CERTIFICATE OF CORRECTION

PATENT NO. : 6,948,881 B1
APPLICATION NO. : 10/395037
DATED : September 27, 2005
INVENTOR(S) : David Fredriksson et al.

It is certified that error appears in the above-identified patent and that said Letters Patent is hereby corrected as shown below:

Column 9, claim 26, line 63, "the injector barrel injector assembly" should read --the injector assembly--.

Signed and Sealed this

Eleventh Day of July, 2006

JON W. DUDAS
*Director of the United States Patent and Trademark Office*